US011478034B2

(12) United States Patent
Newman

(10) Patent No.: US 11,478,034 B2
(45) Date of Patent: Oct. 25, 2022

(54) SYSTEM FOR HEADWEAR SIZE ADJUSTMENT

(71) Applicant: Jesse Newman, Pittsford, NY (US)

(72) Inventor: Jesse Newman, Pittsford, NY (US)

( * ) Notice: Subject to any disclaimer, the term of this patent is extended or adjusted under 35 U.S.C. 154(b) by 0 days.

(21) Appl. No.: 17/035,085

(22) Filed: Sep. 28, 2020

(65) Prior Publication Data

US 2022/0095732 A1 Mar. 31, 2022

Related U.S. Application Data

(60) Provisional application No. 62/935,130, filed on Nov. 14, 2019.

(51) Int. Cl.

| | |
|---|---|
| ***A42B 1/22*** | (2006.01) |
| ***A44B 19/00*** | (2006.01) |
| ***A44B 11/04*** | (2006.01) |
| ***A44B 11/02*** | (2006.01) |

(52) U.S. Cl.

CPC ..... *A42B 1/22* (2013.01); *A44B 19/00* (2013.01); *A44B 11/02* (2013.01); *A44B 11/04* (2013.01); *Y10T 24/44632* (2015.01); *Y10T 24/45225* (2015.01)

(58) Field of Classification Search

CPC ..... A44B 11/02; A44B 11/06; A44B 19/00; A44B 1/22; A44B 11/04; Y10T 24/44632; Y10T 24/44573; Y10T 24/45225

See application file for complete search history.

(56) References Cited

U.S. PATENT DOCUMENTS

| | | | | | |
|---|---|---|---|---|---|
| 2,282,410 | A * | 5/1942 | Roseman | A44B 13/0017 | 24/DIG. 43 |
| 4,477,929 | A * | 10/1984 | Mattsson | A42B 3/324 | 2/418 |
| 4,727,630 | A * | 3/1988 | Alan | A44B 11/26 | 24/593.11 |
| 4,976,017 | A * | 12/1990 | Frano | A44B 11/20 | 24/DIG. 43 |
| 5,313,669 | A * | 5/1994 | Rasdell | A41F 17/00 | 2/112 |
| 5,600,875 | A * | 2/1997 | Chang | A44B 11/02 | 24/200 |
| 5,617,588 | A * | 4/1997 | Canavan | A44B 11/04 | 2/431 |
| 5,752,298 | A * | 5/1998 | Howell | A42B 3/166 | 2/418 |
| 6,219,851 | B1 * | 4/2001 | Fang | A42B 3/145 | 2/418 |
| 6,219,889 | B1 * | 4/2001 | Lovato | A44B 11/12 | 24/615 |
| 6,314,587 | B1 * | 11/2001 | Fang | A42B 3/145 | 2/418 |
| 6,332,227 | B1 * | 12/2001 | Fang | A42B 3/145 | 2/418 |
| 6,457,210 | B1 * | 10/2002 | Shirai | A44B 11/06 | 24/16 PB |

(Continued)

*Primary Examiner* — Heather Mangine
*Assistant Examiner* — Raquel M. Weis
(74) *Attorney, Agent, or Firm* — Chip Law Group

(57) ABSTRACT

A mechanism to adjust the size of headwear is provided. Two engagement clips attach to either side of an open space on the headwear. A tooth/track connects the two clips. The clips may be adjusted to fit the size of the head.

15 Claims, 3 Drawing Sheets

(56) References Cited

U.S. PATENT DOCUMENTS

| | | | | |
|---|---|---|---|---|
| 6,684,462 | B1 * | 2/2004 | Narula | A44B 11/02 24/493 |
| 6,760,927 | B2 * | 7/2004 | Guay | A42B 3/145 2/418 |
| 7,246,383 | B2 * | 7/2007 | Musal | A42B 3/145 2/418 |
| 8,146,211 | B2 * | 4/2012 | Shirai | A41F 1/008 24/191 |
| 8,650,665 | B2 * | 2/2014 | Shirai | A41F 1/008 2/183 |
| 9,474,332 | B1 * | 10/2016 | Naranjo | A44B 11/02 |
| 2005/0262618 | A1 * | 12/2005 | Musal | A42B 3/145 2/417 |
| 2010/0175232 | A1 * | 7/2010 | Shirai | A44B 11/06 24/641 |
| 2010/0200155 | A1 * | 8/2010 | Mrocki | A45C 13/20 156/212 |
| 2011/0016676 | A1 * | 1/2011 | Gray | B60P 7/0869 24/570 |
| 2011/0258821 | A1 * | 10/2011 | Kunst | A44B 11/06 24/457 |
| 2012/0304368 | A1 * | 12/2012 | Waller | A44B 11/04 2/431 |
| 2013/0042446 | A1 * | 2/2013 | Tseng | A43C 11/1413 428/167 |
| 2014/0201950 | A1 * | 7/2014 | Girault | F21V 21/084 24/3.13 |

* cited by examiner

SYSTEM FOR HEADWEAR SIZE ADJUSTMENT

CROSS-RELATED APPLICATIONS

This application claims priority of Provisional Application Ser. No. 62/935,130, filed Nov. 14, 2019, the contents of which are incorporated herein by reference.

FIELD OF THE INVENTION

The present invention relates generally to a system to adjust the size of headwear around the head such that the headwear fits easily, securely, and comfortably.

BACKGROUND

Headwear, such as baseball caps, hard hats, and other types of headwear (hereinafter referred to as "caps"), remain a vital tool and popular accessory for the human population. Due to the range of sizes of the human head, various systems exist to ensure that the headwear remains on the head in a safe, secure, and comfortable fashion. Situations such as wind, hairstyles, perspiration, athletic activities, temperature, elevation, or general discomfort and irritation all warrant the need for a cap adjustment system. However, current cap size adjustment systems are inadequate for a number of reasons.

Present cap size adjustment systems include a snapback system, featuring a series of pegs and corresponding holes on two long pieces of bendable plastic, one on each side of the headwear, allowing users to choose a size that best fits their head by attaching the pegs on one side of the headwear into the corresponding holes on the other side of the headwear. Common snapbacks use approximately seven (7) pegs and seven (7) holes, allowing for eleven (11) to thirteen (13) pegs adjustment increments. Each hole requires material to surround it which allows it to maintain structural integrity. The snapback system has limitations. The material which surrounds each hole limits the number of increments available. The number of pegs/holes may be insufficient to fit the head size of all users, i.e. there may not be enough pegs/holes because the head is either too big or too small for the number of pegs/holes available. The snapback system also gives users an in-between fit feeling, where the cap feels either too tight or too loose. The system is not symmetrical, as it can only be adjusted from one side because the pegs are on one side of the cap and the holes are on the other.

A second cap size adjustment system includes an elastic fit system, wherein a piece of elastic is attached to the structure of the headwear such that when the elastic is in its relaxed position, the headwear is in its smallest state. When placed upon the head, the elastic stretches to fit the head and secure the headwear. However, this elastic stretches out over time, taking the structure of the headwear with it. The elastic fit system is limited in its smallest state by the relaxed position of the elastic, and in is limited in its largest state by the fabric which is attached to the elastic. With the elastic fit system, the elastic provides tension back on the wearer's head; while this provides a secure fit, the tension can also be uncomfortable, and the more the elastic is stretched the more tension it applies back to the wearer. Elastic fit systems are not preferred because the elastic wears out over time to destroy the structure of the cap, the system creates headaches as the elastic is constantly under tension, and the system does not offer the same length of adjustment as other fit systems because the elastic limits the original size and amount of stretch. Caps secured by the elastic fit systems also slide and/or stretch out over time, causing a creep effect which makes the cap feel loose.

A third cap size adjustment system consists of a fabric strap and buckle, wherein a fabric strap creates the range of fit and a buckle sets the position of the fit. The fabric strap/buckle system is not preferred as it is non-symmetrical and gives the cap a sloppy appearance. The fabric strap stretches out over time, causing a creep effect which makes the cap feel loose. The fabric strap/buckle system will eventually get a depression set in the fabric strap where the cap is most commonly worn. It is then difficult to place the buckle anywhere near the depression set without the adjustment system reverting back into the depression set created by the buckle. This causes a problem when searching for a minor increment adjustment.

Further, the above systems adjust the cap by pulling towards one direction, which renders the cap asymmetrical. To adjust the cap using the above systems, either the snapback or fabric strap/buckle systems, the cap must be removed from the head. This can be awkward and cause a disturbance to the task at hand or be uncomfortable to the user who does not wish to remove the cap.

Thus, a need exists for a headwear adjustment mechanism that will not lose structural integrity by stretching out and losing its original tension and flexibility, offers consistent comfortability, is easy to adjust, and has a precise fit.

SUMMARY

The present invention offers a cap size adjustment system that solves the problems of inaccurate sizing, uncomfortability, stretchiness, asymmetry, and difficulties with adjustment presented by existing cap size adjustment systems. The current invention solves the aforementioned problems with an increased number of size increments, symmetrical design, durability, and hassle-free adjustment.

In an embodiment of the present invention, a system for adjusting caps is disclosed. This system includes three components—a centrally located track with teeth which extends across the area of the cap worn on the back of the head, hereinafter referred to as Side B, and two opposing clip engagement components, one on each side of Side B, which interface with the track teeth and holds the cap in an incremental size. This system offers minor increments in adjustment because it doubles (or more) the number of adjustments within the same length of track as the prior art, leading to improved fit and comfort. The system maintains its structural integrity because it does not become worn out, creep along the head, or become stretched out over time. The system further maintains its structural integrity because it locks in fit and is not subject to material fatigue or stretching out associated with elastic and fabric strap/buckle designs. It is symmetrical in appearance because it can be adjusted from both sides, does not gain a depression set as no fabric/buckle is used, and can be adjusted without cap removal because to adjust the size, the user pushes or pulls on the clips without taking the cap off the head. The invention eliminates the need for peg holes used in snapback systems, so that the entire structure of the track is utilized for both structural integrity and size adjustment. Further, the system is low-profile in nature, as the teeth side of the track faces against the head. This allows the smooth portion to be exposed outward away from the head and, as such, this smooth portion can be customized with colors, logos, names, and the like.

BRIEF DESCRIPTION OF THE DRAWINGS

The following detailed description of the preferred embodiment(s) of the present invention will be better understood when read in conjunction with the appended drawings. The present invention is illustrated by way of example, and not limited by the accompanying figures, in which like references indicate similar elements, and in which.

DETAILED DESCRIPTION

Figure 1:
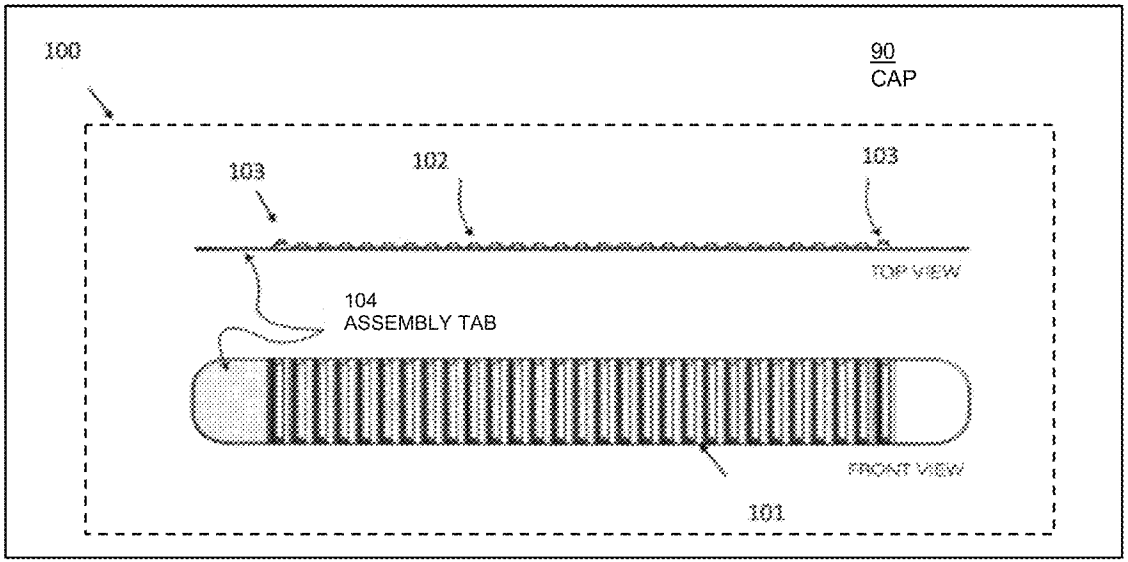
FIG. 1 represents the tooth/track component of the cap size adjustment system of a cap, in accordance with an embodiment of the present invention.

The present invention is best understood with reference to the detailed figures and descriptions set forth herein. Reference will now be made in detail to presently preferred compositions, embodiments and methods of the present invention, which constitute the best modes of practicing the invention presently known to the inventor. It is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

All numerical quantities in this description indicating amounts of material or conditions of use are to be understood as modified by the word "about" in describing the broadest scope of the invention. Practice within the numerical limits stated is generally preferred. Also, unless expressly stated to the contrary: the description of a group or class of materials as suitable or preferred for a given purpose in connection with the invention implies that mixtures of any two or more of the members of the group or class are equally suitable or preferred.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification be considered as exemplary only, with a true scope and spirit of the invention being indicated by the following claims. The following description of the embodiment(s) is merely exemplary in nature and is in no way intended to limit the invention, its application, or uses.

Overview

Various types of headwear are common in the general population, both for aesthetics and practical uses such as protection. As stated above, current adjustment mechanisms for headwear are inadequate for a variety of reasons.

Various embodiments of the present invention provide a system that solves the abovementioned problems by allowing the user to have a consistent, comfortable, and sturdy adjustment of the user's chosen cap. As described with the present invention, caps have four areas—the front (Side A); the left side (Side B); right side (Side C); the back side (Side D). The cap size adjustment system of the present invention is located on Side D and incorporates three components—a centrally located track with teeth which extends across Side D and two opposing clip engagement components attached to Side D which interface with the track and hold the cap in an incremental size. To adjust the cap, the clips are pushed or pulled in any direction to move over the track, until the appropriate tooth is reached. Because the clips and track are never fully separated, the adjustment system always remains engaged and the user can adjust the size without taking off the cap.

FIG. 1 illustrates the track/tooth component 100 of the adjustment mechanism of a cap 90, in a preferred embodiment of the present invention. The track 101 is shown with a front view and top view. Track 101 has one side with adjustment teeth and stopper teeth, described below, and the other side is smooth. The front view is held within Side D, with the side of track 101 with the adjustment teeth held against the head and the smooth side facing away from the head. The track 101 is about five inches long, 0.75 inches wide, and 0.075 inches thick. Adjustment teeth 102 are located on the track and used for multiple sizing increments, ranging from about 5 inches when the track is fully open to about 0.75 inches when the track is fully closed, to allow for minor increments in size adjustment. The adjustment teeth 102 are about 17-18 mm long, about 0.075 inches (2 mm) tall, and about 0.075 inches (2 mm) wide. The adjustment teeth 102 are about 0.15 inches (4 mm) away from each other, center to center, which allows for minor increments in adjustment size of about 4 mm. The adjustment teeth 102 are rounded to provide smooth adjustment and increased comfort to the user's head. The track 101 has about thirty (30) adjustment teeth, which is about double the amount of adjustment sizes offered by prior art. The stopper teeth 103 are located one on each end of the track. The stopper teeth 103 are slightly higher than the adjustment teeth 102 such that the clip component, described in FIG. 2, can raise and lower along the track. The stopper teeth 103 are small enough to allow for assembly of the track system while large enough to not allow the user to adjust past the stopper teeth 103. Stopper teeth 103 are the last teeth in track 101 in the adjustment system and maximum in size of the adjustment teeth. Stopper teeth 103 are located so that the assembly tab remains inside the fabric portion of the hat for a clean and user-friendly experience. The assembly tabs 104 are located at each end of the track, and smooth, not ridged like the adjustment teeth 102 and stopper teeth 103. The assembly tabs 104 aid in putting the track through the engagement clip component at each end and maintain their position inside the portion of the cap. Further, by keeping the assembly tabs 104 within the portion of the cap, the track is unlikely to snag any portion of either the cap or the user's head during fit or adjustment.

Figure 3:
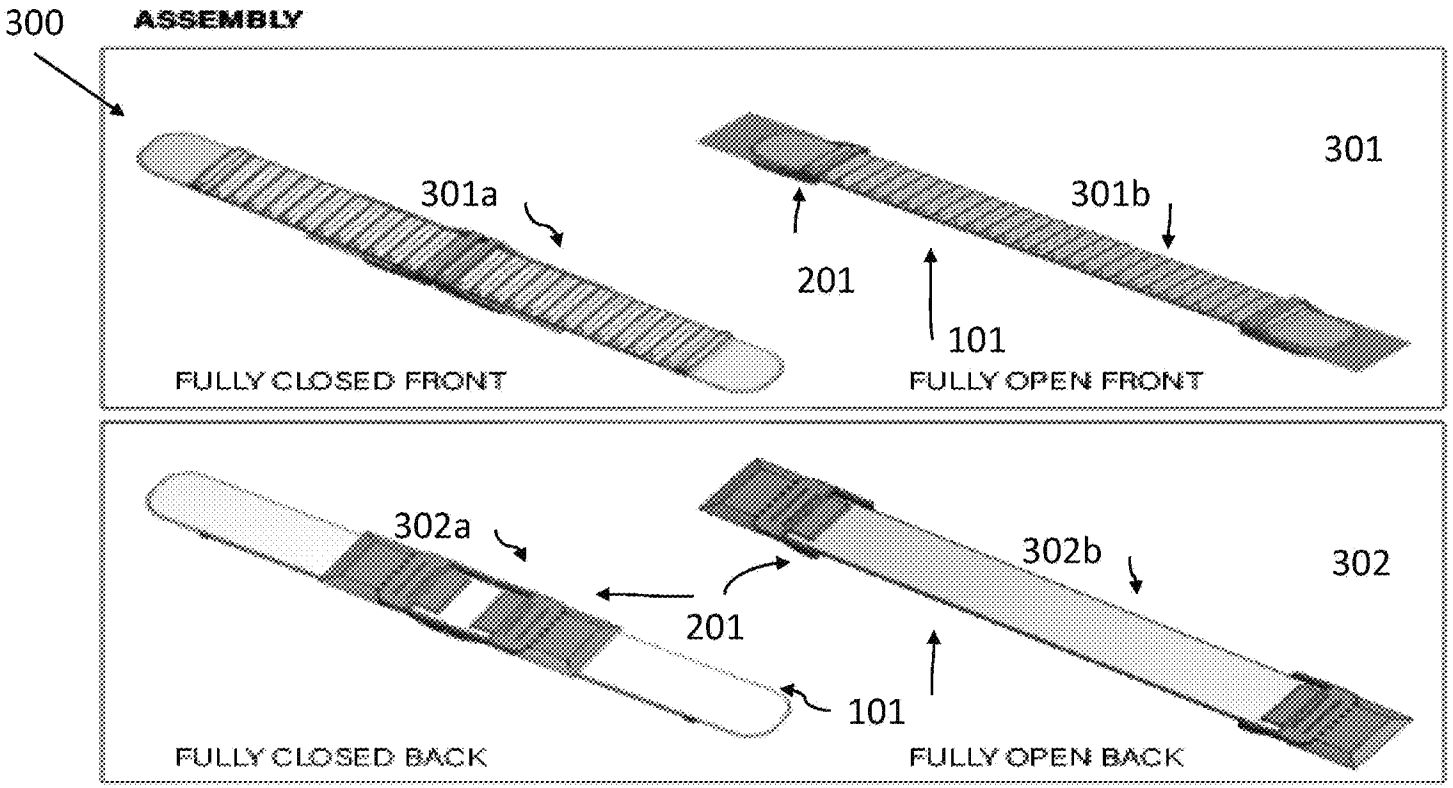
FIG. 3 represents the three components of the cap size adjustment system, at the fully open and fully closed positions, in accordance with an embodiment of the present invention.

The cap size adjustment system is engaged/locked when the two clip components are clipped along the track 101. The visible portion of track 101 from the exterior of the hat has a fit range of approximately 5 inches when fully open, 0.75 inches when fully closed. Open and closed views of the track 101 are shown in FIG. 3. The dimensions of the track 101, adjustment teeth 102, and stopper teeth 103 herein disclosed are representative of a preferred embodiment, and it should be understood by a person of ordinary skill that these dimensions can range without taking away from the spirit and scope of the present invention.

Figure 2:
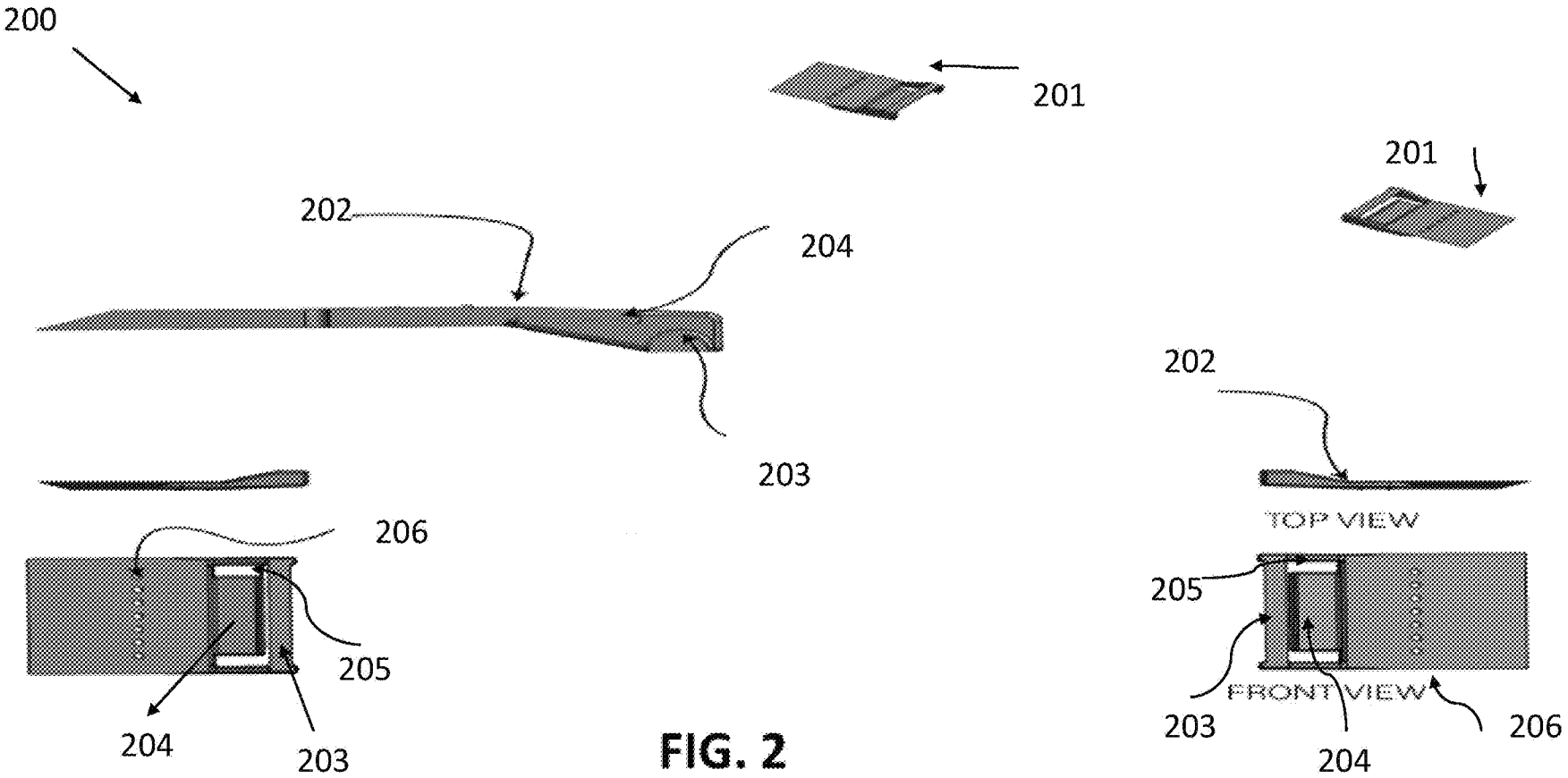
FIG. 2 represents the clip component of the cap size adjustment system, in accordance with an embodiment of the present invention.

FIG. 2 illustrates the engagement clip component 200 in accordance with the present invention. The engagement clip 201 is shown with a front view and top view. The engagement clip 201 consists of a hinge zone 202, clip 203 to engage the adjustment teeth, negative pressure area 204, and feed area 205 through which to feed the track 101. The engagement clip 201 releasably engages with the corresponding adjustment teeth 102 located within track 101. The hinge zone 202 is the area in which the engagement clip 201 and negative pressure area 204 can flex/hinge. Area 202 is where the user puts pressure in order to bend the plastic for adjustment; once pressure is released, the plastic bends back to its original state to keep the adjustment in place. Without area 202 the engagement clip would not be able to move into different size increments. The hinge zone 202 relies on the mechanical properties of plastic or other like materials to flex during sizing adjustment and return to normal during a resting state. This also allows the system to maintain its structural integrity, or shape and flexibility, and not wear out or stretch out such that it cannot be used. The negative pressure area 204 provides a negative force against the engagement clip 201. The negative pressure area 204 forces the engagement clip down for solid engagement. The negative pressure area 204 holds the components into a tight orientation for a responsive adjustment and comfortable fit.

The cap size adjustment system contains two of the engagement clip components 200, one on each side of Side D in which the track 101 is fed. The engagement clips provide significant engagement with the track so as to not become loose during regular wear. The engagement clips may ride along the track to a different size increment if the user applies pressure to the hinge zone 202. The engagement clip components 200 may be sewn, glued, or otherwise attached to the cap. In one embodiment, sewing holes 206 may be placed on the clip component 200 to attach 200 to the cap. The engagement clip components 200 may be made of plastic or other similar material. Unlike other adjustment systems, this enables the system to maintain its structural integrity over time, as it will not wear out, stretch out, or lose its flexibility. The system keeps its structural integrity by holding together during use over time, without deforming or changing the shape of the cap. The engagement clip components 200 is a symmetrical design, as in the exact same component is used on both ends of the track. This is important for many reasons previously mentioned, such as aesthetics and manufacturability.

FIG. 3 illustrates the entire cap size adjustment system 300 at the fully open and fully closed positions, including both track component 101 and engagement clip component 201. The front view 301 faces the head while the back view 302 faces the outside, away from the head. This allows the smooth area of 302 to be customized with colors, logos, names, and the like. The views 301*a* and 301*b* show the front view of the system in its fully closed and fully open positions, respectively. The views 302*a* and 302*b* show the back view in the fully closed and fully open positions, respectively. The system 300 is fully adjustable in all increments between the fully open and fully closed positions. This allows for minor incremental adjustments in size of about 4 mm, with a size range of about 5 inches when the track is fully open, i.e. the engagement clips are all the way to the end of each side of track, to about 0.75 inches when the track is fully closed and the engagement clips are next to each other on the track. As such this system contains more sizing options than the prior art; these sizing options likewise were not anticipated by the prior art, because there is no way with the peg/holes system that these small adjustments would fit. While the system does not need to remain exactly symmetrical during adjustment, the system will appear symmetrical in all exposed areas.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A system for adjusting a size of a headwear, comprising of:

a track having a first side and a second side, wherein the first side comprises teeth thereon and the second side comprises a smooth face, wherein the track is configured to extend across an area of a back side of the headwear, wherein the teeth further comprise a plurality of adjustment teeth on the first side of the track and a stopper tooth on each end of the first side of the track, and wherein a height of the stopper tooth is greater than a height of the plurality of adjustment teeth;

two opposing engagement clips are configured to attach to the back side of the headwear, spaced approximately five inches apart, with the track in between the two opposing engagement clips, wherein the two opposing engagement clips interface with the teeth on the first side of the track for minor increments of adjustment sizes, and the system maintains structural integrity by not wearing out or losing its shape or flexibility over time; and a plurality of smooth assembly tabs, wherein each smooth assembly tab of the plurality of smooth assembly tabs corresponds to a smooth surface located beside the stopper tooth at each end of the track, wherein a corresponding end of the track extends through one of the two opposing engaging clips via the smooth assembly tab located at the corresponding end of the track, wherein the stopper tooth is a last tooth of the teeth on the track, and wherein the stopper tooth is maximum in size of the plurality of adjustment teeth.

2. The system of claim 1, wherein the teeth on the first side of the track face the head when in use, and the smooth face of the track faces away from the head when in use.

3. The system of claim 2, wherein adjustments to the size of the headwear are made by pushing or pulling on the two opposing engagement clips without removing the headwear from the head when in use.

4. The system of claim 3, wherein a fit of the headwear is adjusted symmetrically by pushing or pulling on the two opposing engagement clips when in use.

5. The system of claim 1, wherein the two opposing engagement clips contain a clip to secure to the track.

6. The system of claim 5, wherein the two opposing engagement clips contain a hinge zone.

7. The system of claim 6, wherein the two opposing engagement clips contain a negative pressure area.

8. The system of claim 7, wherein adjustments to the size of the headwear are made by pushing or pulling on the two opposing engagement clips without removing the headwear from the head when in use.

9. The system of claim 8, wherein a fit of the headwear is adjusted symmetrically by pushing or pulling on the two opposing engagement clips when in use.

10. The system of claim 1 wherein the track is made of plastic.

11. The system of claim 1 wherein the two opposing engagement clips are made of plastic.

12. The system of claim 1 wherein the two opposing engagement clips are configured to be sewn to the back side of the headwear.

13. The system of claim 1 wherein the two opposing engagement clips are configured to be glued to the back side of the headwear.

14. The system of claim 1 wherein an entire structure of the track that comprises the teeth on the first side and the smooth face on the second side is used for size adjustment.

15. A system for adjusting a size of headwear, comprising of:

a track having a first side and a second side, wherein the first side comprises teeth thereon, and the second side comprises a smooth face, wherein the track is configured to extend across an area on a back side of the headwear, and wherein the teeth further comprise a plurality of adjustment teeth on the first side of track and a stopper tooth on each end of the first side of the track, and wherein a height of the stopper tooth is greater than a height of the plurality of adjustment teeth;

two opposing engagement clips are configured to attach to the back side of the headwear, spaced approximately five inches apart, with the track in between the two opposing engagement clips, wherein the two opposing engagement clips interface with the teeth on the first side of the track for minor increments of adjustment sizes, the system maintains structural integrity by not wearing out or losing its shape or flexibility over time, and wherein adjustments to the size of the headwear are made by pushing or pulling on the two opposing engagement clips without removing the headwear from the head when in use, and a fit of the headwear is adjusted symmetrically by pushing or pulling on the two opposing engagement clips when in use; and a plurality of smooth assembly tabs, wherein each smooth assembly tab of the plurality of smooth assembly tabs corresponds to a smooth surface located beside the stopper tooth at each end of the track, wherein a corresponding end of the track extends through one of the two opposing engaging clips via the smooth assembly tab located at the corresponding end of the track, wherein the stopper tooth is a last tooth of the teeth on the track, and wherein the stopper tooth is maximum in size of the plurality of adjustment teeth.

* * * * *